US010385511B2

(12) United States Patent
Burazin et al.

(10) Patent No.: US 10,385,511 B2
(45) Date of Patent: Aug. 20, 2019

(54) THREE-DIMENSIONAL PAPERMAKING BELT

(71) Applicant: Kimberly-Clark Worldwide, Inc., Neenah, WI (US)

(72) Inventors: Mark Alan Burazin, Oshkosh, WI (US); Geoffrey Fenn Carlow, Neenah, WI (US); Lynda Ellen Collins, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/094,629

(22) PCT Filed: Jul. 25, 2017

(86) PCT No.: PCT/US2017/043666
§ 371 (c)(1),
(2) Date: Oct. 18, 2018

(87) PCT Pub. No.: WO2018/022586
PCT Pub. Date: Feb. 1, 2018

(65) Prior Publication Data

US 2019/0106841 A1 Apr. 11, 2019

Related U.S. Application Data

(60) Provisional application No. 62/367,945, filed on Jul. 28, 2016.

(51) Int. Cl.
*D21F 7/08* (2006.01)
*D21F 7/12* (2006.01)
(Continued)

(52) U.S. Cl.
CPC ..... *D21F 7/083* (2013.01); *D21F 1/0063* (2013.01); *D21F 1/80* (2013.01); *D21F 3/02* (2013.01);
(Continued)

(58) Field of Classification Search
CPC . D21F 1/00; D21F 1/10; D21F 1/0063; D21F 1/80; D21F 7/08; D21F 7/083;
(Continued)

(56) References Cited

U.S. PATENT DOCUMENTS 5,245,025 A 9/1993 Trokhan
5,900,122 A 5/1999 Huston
(Continued)

FOREIGN PATENT DOCUMENTS

WO WO16085704 A1 6/2016

*Primary Examiner* — Eric Hug
(74) *Attorney, Agent, or Firm* — Kimberly-Clark Worldwide, Inc.

(57) ABSTRACT

The present invention relates to papermaking belts useful in the manufacture of paper products, such as tissue paper. Particularly this invention relates to a papermaking belt used in a through-air drying process for making tissue products, and more particularly to a belt having a particular pattern thereon which imparts properties to tissue products manufactured therewith. In some embodiments, the belt can be seamless. The belt can include a first web contacting area defining a first plane and a second web contacting area defining a second plane. The second plane can be above the first plane. The first web contacting area and the second web contacting area comprise a plurality of channels that extend from the web contacting side to the machine contacting side of the seamless papermaking belt.

20 Claims, 3 Drawing Sheets

(51) Int. Cl.

| | |
|---|---|
| ***D21F 1/00*** | (2006.01) |
| ***D21F 1/80*** | (2006.01) |
| ***D21F 3/02*** | (2006.01) |
| ***D21F 11/00*** | (2006.01) |
| ***D21H 27/00*** | (2006.01) |
| *D21F 5/18* | (2006.01) |

(52) U.S. Cl.
CPC ..... *D21F 7/12* (2013.01); *D21F 11/006* (2013.01); *D21H 27/002* (2013.01); *D21F 5/182* (2013.01)

(58) Field of Classification Search
CPC ..... D21F 7/10; D21F 11/006; D21F 5/182; D21H 27/002; D21H 27/02
USPC ..... 162/109–117, 296, 348, 358.2, 361, 362, 162/900, 902, 903
See application file for complete search history.

(56) References Cited

U.S. PATENT DOCUMENTS

| | | | | |
|---|---|---|---|---|
| 5,972,813 | A | 10/1999 | Polat | |
| 2005/0280184 | A1* | 12/2005 | Sayers | D04H 3/02 264/308 |
| 2012/0189806 | A1 | 7/2012 | Hansen | |
| 2016/0053436 | A1* | 2/2016 | Morton | D21F 11/006 162/353 |
| 2016/0083906 | A1 | 3/2016 | Hill | |
| 2016/0159007 | A1* | 6/2016 | Miller, IV | D21F 1/0027 162/348 |

* cited by examiner

THREE-DIMENSIONAL PAPERMAKING BELT

BACKGROUND

The present invention relates to the field of paper manufacturing. More particularly, the present invention relates to the manufacture of absorbent tissue products such as bath tissue, facial tissue, napkins, towels, wipers, and the like. Specifically, the present invention relates to improved papermaking belts used to manufacture absorbent tissue products having background regions optionally bordered by decorative elements, methods of tissue manufacture, methods of fabric manufacture, and the actual tissue products produced thereby.

In the manufacture of tissue products, particularly absorbent tissue products, there is a continuing need to improve the physical properties and final product appearance. It is generally known in the manufacture of tissue products that there is an opportunity to mold a partially dewatered cellulosic web on a papermaking belt specifically designed to enhance the finished paper product's physical properties. Such molding can be applied by fabrics in an uncreped through-air dried process as disclosed in U.S. Pat. No. 5,672,248 or in a wet pressed tissue manufacturing process as disclosed U.S. Pat. No. 4,637,859. Wet molding typically imparts desirable physical properties independent of whether the tissue web is subsequently creped, or an uncreped tissue product is produced.

However, absorbent tissue products are frequently embossed in a subsequent operation after their manufacture on the paper machine, while the dried tissue web has a low moisture content, to impart consumer preferred visually appealing textures or decorative lines. Thus, absorbent tissue products having both desirable physical properties and pleasing visual appearances often require two manufacturing steps on two separate machines. Hence, there is a need for a single step paper manufacturing process that can provide the desired visual appearance and product properties. There is also a need to develop a paper manufacturing process that not only imparts visually discernable pattern and product properties, but which does not affect machine efficiency and productivity.

Previous attempts to combine the above needs, such as those disclosed in International Application Nos. PCT/US13/72220, PCT/US13/72231 and PCT/US13/72238 have utilized through-air drying fabrics having a pattern extruded as a line element onto the fabric. The extruded line element may form either discrete or continuous patterns. While such a method can produce textures, extrusion techniques are limited in the types of lines that may be formed resulting in reduced permeability of the through-air drying fabric. The reduced permeability in-turn decreases drying efficiency and negatively affects tissue machine efficiency and productivity.

Additionally, traditional papermaking belts 10 are formed to be endless belts by the joining of a seam 12, as illustrated in FIG. 1. The seam 12 can be joined in a cross-direction CD to the papermaking belt 10. Seams 12 can provide a source of breakdown for the papermaking belt 10 over time, ultimately leading to the need for replacement of the papermaking belt 10. In fact, such limitations due to seams 12 can prevent the commercialization of otherwise desirable papermaking products due to the reduced longevity of a papermaking belt 10.

Seams 12 in a belt 10 can also impart undesirable or inconsistent characteristics to the tissue web. The seam 12 can provide varying characteristics in air transfer/permeability of the papermaking belt 10 in comparison to other areas of the papermaking belt 10 not at the seam 12, which can lead to inconsistent characteristics for the tissue web that contacts or is associated with the seam 12. In addition, seams 12 can provide difficulty in transferring a pattern from the belt 10 to the tissue web leading to bad aesthetics of the web, wet spots on the web, and/or sheet breaks.

As such, there remains a need for articles of manufacture and methods of producing tissue products having visually discernable patterns with improved physical properties without losses to tissue machine efficiency and productivity.

SUMMARY

The present invention comprises paper manufacturing articles and processes that may satisfy one or more of the foregoing needs. For example, a paper manufacturing belt of the present invention, when used as a through-air drying fabric in a tissue making process, produces an absorbent tissue product having a substantially uniform density as well as optionally possessing visually discernible decorative elements. The present invention is also directed towards fabrics for manufacturing the absorbent tissue product, processes of making the absorbent tissue product, and processes of making the fabric.

Accordingly, in one aspect a papermaking belt is provided that includes a seamless papermaking belt. The seamless papermaking belt can include a machine contacting side and a web contacting side. The web contacting side can be opposite from the machine contacting side. The web contacting side can include a first web contacting area defining a first plane and a second web contacting area defining a second plane. The second plane can be above the first plane. The first web contacting area and the second web contacting area can comprise a plurality of channels that extend from the web contacting side to the machine contacting side of the seamless papermaking belt.

In another aspect, a papermaking belt is provided that includes a machine contacting side and a web contacting side opposite from the machine contacting side. The machine contacting side can include a machine contacting side belt material. The web contacting side can include a first web contacting area defining a first plane and including a first belt material. The first belt material can be the same material as the machine contacting side belt material. The web contacting side can also include a second web contacting area defining a second plane. The second plane can be above the first plane. The second web contacting area can include a second belt material. The papermaking belt can also include a plurality of channels. The plurality of channels can extend from the web contacting side to the machine contacting side.

DEFINITIONS

Figure 1:
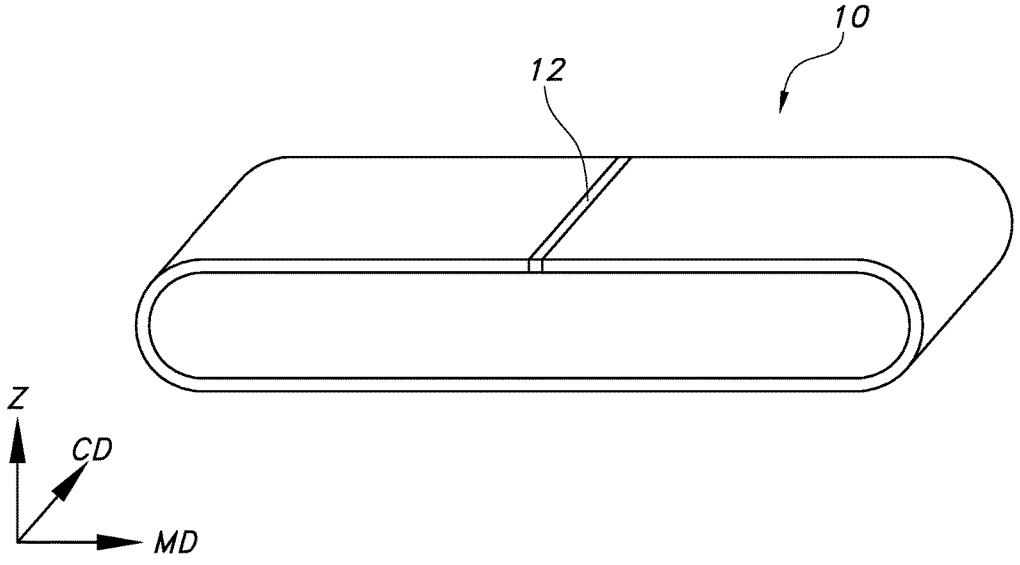
FIG. 1 illustrates a top perspective view of an exemplary papermaking belt of the prior art including a seam.

As used herein, the term "channel" generally refers to a passage extending entirely through an element.

As used herein, the term "aperture" generally refers to an opening end of a channel.

As used herein, the term "tissue product" generally refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" generally refer to a fibrous sheet material suitable for forming a tissue product.

As used herein, the term "continuous protuberance" generally refers to a three-dimensional element on a papermaking belt that extends without interruption throughout one dimension of the belt.

As used herein, the term "discrete protuberance" generally refers to separate, unconnected three-dimensional elements disposed on a papermaking belt that do not extend continuously in any dimension of the belt.

As used herein, the term "curvilinear decorative element" generally refers to any line or visible pattern that contains either straight sections, curved sections, or both that are substantially connected visually. Curvilinear decorative elements may appear as undulating lines, substantially connected visually, forming signatures or patterns. Curvilinear decorative elements includes calligraphic lines.

As used herein, the term "decorative pattern" generally refers to any non-random repeating design, figure, or motif. It is not necessary that the curvilinear decorative elements form recognizable shapes, and a repeating design of the curvilinear decorative elements is considered to constitute a decorative pattern.

As used herein, the term "continuous liquid interphase printing" generally refers to a method of forming a three-dimensional object (hereinafter abbreviated to CLIP) as described in International Publication No. WO 2014/126837, the contents of which are hereby incorporated by reference in a manner consistent with the present disclosure, that generally employs a carrier and an optically transparent member having a build surface, the carrier and the build surface defining a build region there between being filled with a polymerizable liquid. A source of irradiation is supplied to the build region through the optically transparent member to form a solid polymer from the polymerizable liquid while increasing a distance between the carrier and the build surface to form a three-dimensional object from the polymer.

As used herein, the term "seamless" when used in reference to a papermaking belt according to the present invention generally refers to a belt that forms a continuous loop in the machine direction without any means for joining pieces, parts or portions of the belt together, such as stitching, sewing, fitting, and lapping.

DETAILED DESCRIPTION

The present inventors have now surprisingly discovered that certain seamless papermaking belts, and in particular seamless through-air drying fabrics having patterns disposed thereon, may be used to produce tissue webs and products that are both smooth and have high bulk without compromising manufacturing efficiency or altering the current manufacturing process. The inventive seamless papermaking belts utilizing new manufacturing methods enable the manufacture of a continuous, endless belt without any seams which also possesses three dimensional surface topography to impart tissue webs and products manufactured therewith with aesthetically appealing patterns and consumer preferred properties such as smoothness and bulk.

Figure 2:
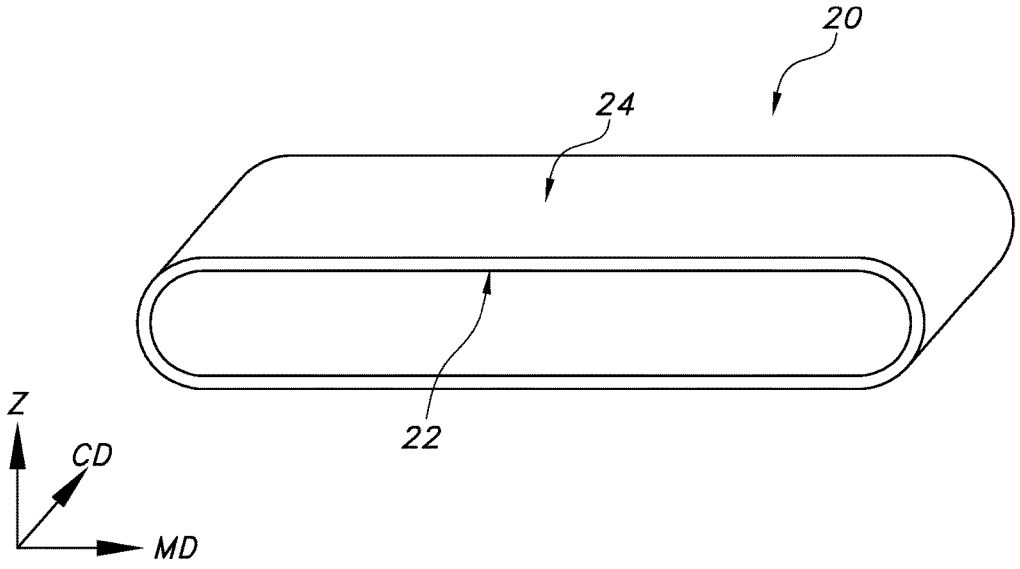
FIG. 2 illustrates a top perspective view of an exemplary papermaking belt according to one embodiment of the present disclosure in which the papermaking belt is seamless.

As illustrated in FIG. 2, in one embodiment, an endless papermaking fabric of a papermaking belt 20 is provided. The papermaking belt 20 can include a machine contacting side 22 and a web contacting side 24. The web contacting side 24 is opposite from the machine contacting side 22. The papermaking belt 20 can be free of a seam as in traditional papermaking belts, such as the seam 12 shown in the papermaking belt 10 of FIG. 1 and described above. The papermaking belt 20 can include various continuous protuberances and/or discrete protuberances. The protuberances may, in certain embodiments, form a decorative pattern. Machinery employed in a typical papermaking operation is well known in the art and may include, for example, vacuum pickup shoes, rollers, and drying cylinders. In one embodiment the belt 20 comprises a through-air drying fabric useful for transporting an embryonic tissue web across drying cylinders during the tissue manufacturing process. In such embodiments the web contacting side 24 supports the embryonic tissue web, while the opposite surface, the machine contacting side 22, contacts the through-air dryer.

Figure 3:
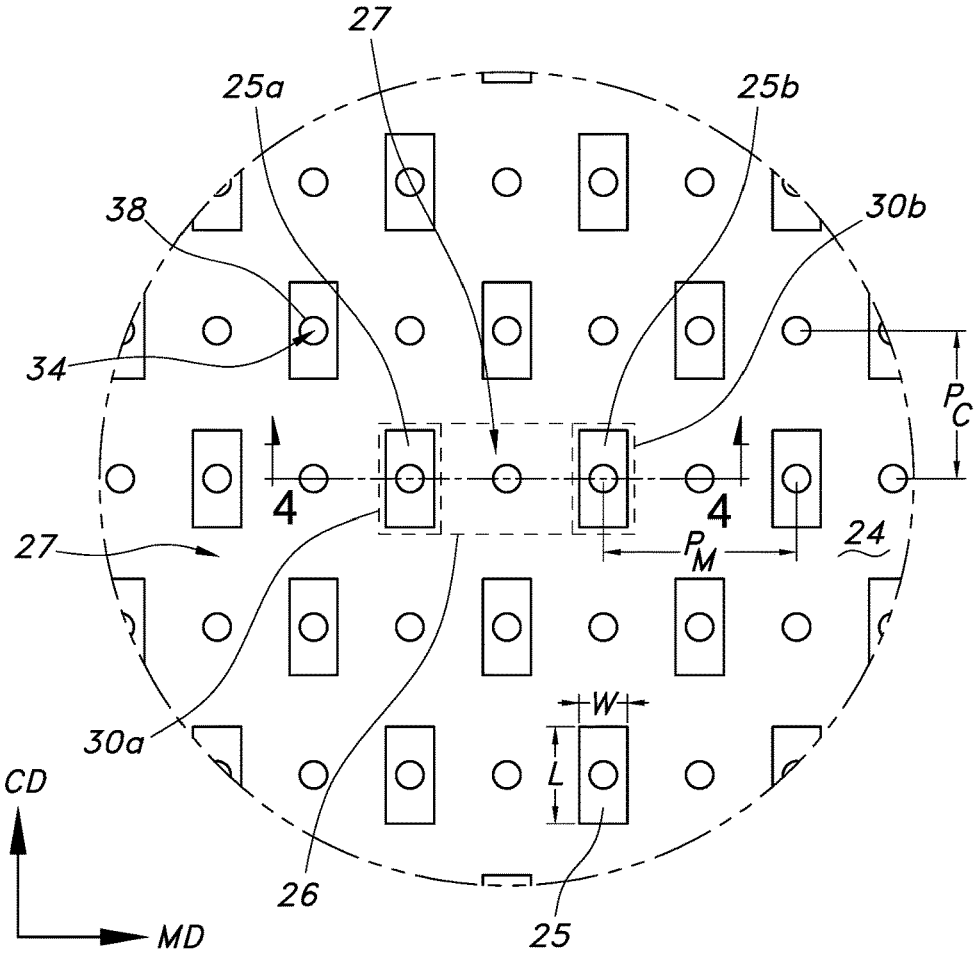
FIG. 3 illustrates a detailed top view of a portion of the web contacting side of the exemplary papermaking belt of FIG. 2.
Figure 4:
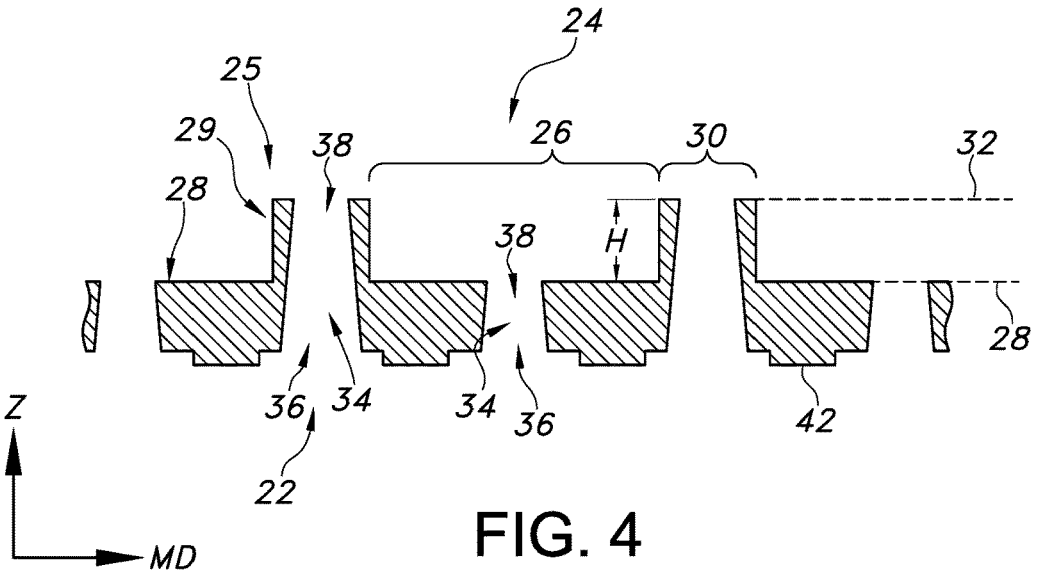
FIG. 4 illustrates a detailed cross-sectional view taken through line 4-4 of FIG. 3.
Figure 5:
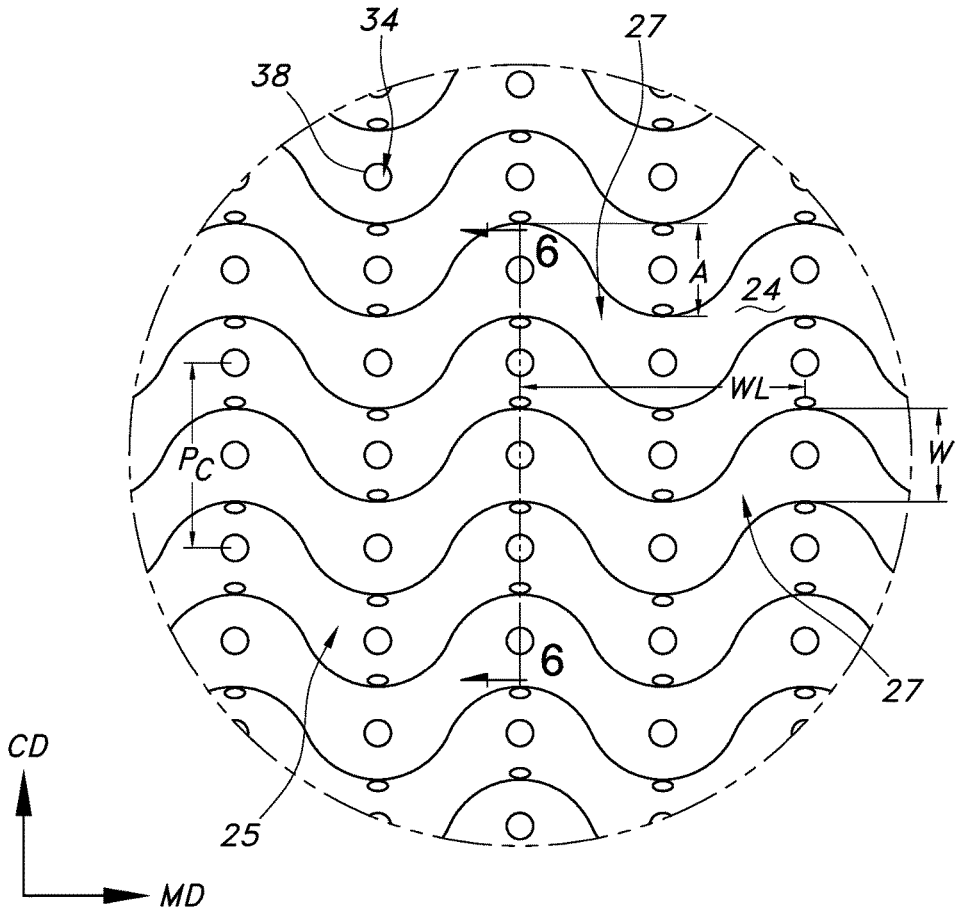
FIG. 5 illustrates a detailed top view of a portion of the web contacting side of a papermaking belt similar to FIG. 2, but of an alternative embodiment of a papermaking belt according to the present disclosure.
Figure 6:
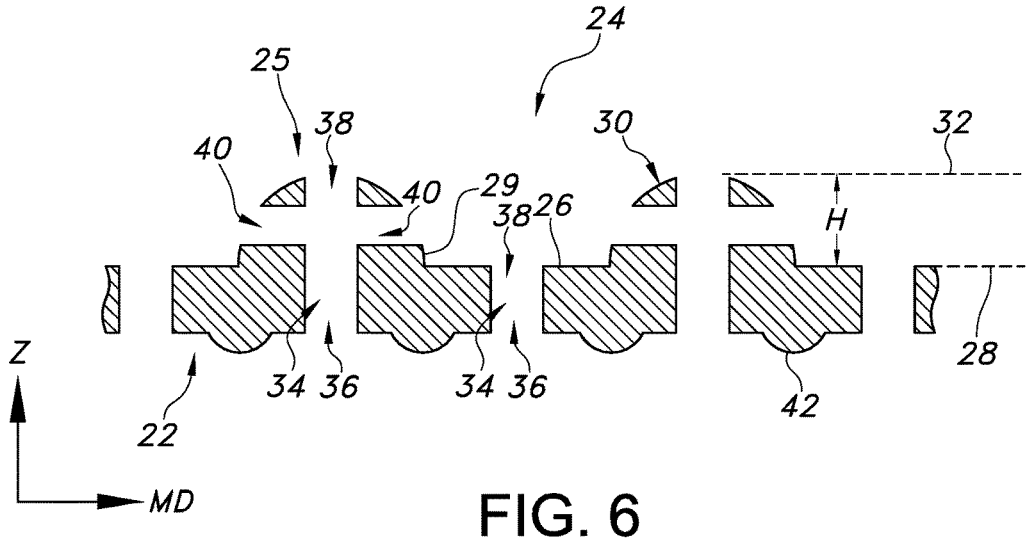
FIG. 6 illustrates a detailed cross-sectional view taken through line 6-6 of FIG. 5.

FIGS. 3 and 4 provide illustrations of discrete portions of the belt 20 of FIG. 2 in more detail. FIGS. 5 and 6 provide similar illustrations to that of FIGS. 3 and 4, but of an alternative embodiment of a belt. Discussion below with respect to the belt 20 of FIGS. 2-4 can be applied to the embodiment illustrated in FIGS. 5 and 6 as well, unless otherwise noted.

The web contacting side 24 of the belt 20 can include a plurality of discrete protuberances 25*a*, 25*b* (only two labeled in FIG. 3 for purposes of clarity) that cooperate with and structure the wet fibrous web during manufacturing. In other embodiments, such as that shown in FIGS. 5 and 6, the web contacting side 24 of the belt 20 can include a plurality of continuously extending protuberances 25*a*, 25*b*. In other embodiments the web contacting surface of the belt may include both discrete and continuous protuberances.

Regardless of whether the web contacting surface comprises discrete and/or continuous protuberances, protuberances generally comprise at least about 5 percent of the surface area of the web contacting side, such as from about 5 to about 35 percent, more preferably from about 10 to about 30 percent, even more preferably from about 10 to about 25 percent, and still more preferably from about 20 to about 25 percent of the surface area of the web contacting side.

In addition to discrete protuberances 25, the web contacting side 24 of the belt 20 can comprise one or a plurality of continuous landing area(s) 27. While the landing area(s) of FIG. 3 are continuous, one skilled in the art will appreciate that in those embodiments where the protuberances are continuous or semi-continuous the land area(s) surrounding the protuberances may be discrete or semi-continuous. For example, the landing area(s) 27 can surround the protuberances 25, as shown in FIG. 3, or can be bounded by the protuberances 25, such as portrayed in FIG. 5.

Generally both the protuberances 25 and the landing areas 27 comprise a channel 34 that is connected to an aperture 38 disposed on the web contacting surface 24. The channels enable the belt to be permeable to both air and liquids. During formation and drying of the web the channels allow water to be removed from the cellulosic fibrous structure by the application of differential fluid pressure, by evaporative mechanisms, or both when drying air passes through the embryonic tissue web while on the papermaking belt or a vacuum is applied through the belt. Without being bound by any particularly theory, it is believed that the arrangement of protuberances and landing areas allow the molding of the embryonic web causing fibers to deflect in the z-direction and generate the caliper of, and aesthetic patterns on, the resulting tissue web, while the channels facilitate dewatering and drying of the web. For example, the spacing of protuberances can be provided such that the tissue web conforms to the surface of the belt without tearing. If the individual landing areas are too large the resulting sheet can have insufficient compression resistance, CD stretch, and CDTEA, and be of poor quality. Conversely, if the spacing between adjacent protuberances is too small the tissue will not mold into the landing areas without rupturing the sheet, causing excessive sheet holes, poor strength, and poor paper quality.

As illustrated in FIGS. 3-6, the protuberances 25 can have a variety of shapes and configurations. For example, the protuberances 25 in the embodiment depicted in FIGS. 3 and 4 form rectangular prisms whereas the protuberances 25 in the embodiment depicted in FIGS. 5 and 6 provide a semi-circular shape in cross-section (as illustrated in FIG. 6) and form a sinusoidal pattern extending in the machine direction (as illustrated in the top view in FIG. 5). In conjunction with the landing area(s) 27, the protuberances 25 can create a decorative pattern that can form a respective decorative pattern on the fibrous web during manufacturing. For example, in FIGS. 3 and 4, the protuberances 25 form discrete protuberances 25 having a discrete height (H), length (L), and width (W). The protuberances can form an array of rows and/or columns and, in some embodiments, can be evenly spaced in both the machine direction (MD) and/or the cross-machine direction (CD). In the embodiment depicted in FIGS. 5 and 6, the protuberances 25 extend the full machine direction (MD) of the belt 20. Of course, it is contemplated that a variety of configurations of protuberances 25 and landing areas 27 can be accomplished, and be oriented in either machine direction (MD) or cross-machine direction (CD) as desired. For example, in other embodiments it is contemplated that the protuberances may be spaced and arranged so as to form a decorative figure, icon or shape such as a flower, heart, puppy, logo, trademark, word(s) and the like.

The web contacting side 24 of the belt 20 can provide a first web contacting area 26 defining a first plane 28. The first web contacting area 26 that can define the first plane 28 can be provided by the landing area(s) 27 of the belt 20. The web contacting side 24 can also provide a second web contacting area 30 defining a second plane 32. The second plane 32 can be above the first plane 28 in terms of a direction normal to the plane created by the machine direction and the cross-machine direction (CD). The second web contacting area 30 that can define the second plane 32 can be provided by one or more protuberances 25. In the example illustrated in FIG. 4, the second plane 32 can be defined at the planar surface of the second web contacting area 30. In the example illustrated in FIG. 6, the second plane 32 can be defined by a plane parallel to the plane created by the machine direction and cross-machine direction that is located at the greatest height (H) of the protuberance 25.

The protuberances 25 can have a channel 34 and opposing sidewalls 29. The sidewalls 29 can be planar (as illustrated in FIGS. 3 and 4), convex (as illustrated in FIGS. 5 and 6), concave, irregular, or in any other desirable shape. As illustrated in FIG. 3, the sidewalls 29 can be vertical or normal to the plane defined by the machine direction (MD) and cross-machine direction (CD), which is preferable in some embodiments. The protuberances 25 can be configured such that the second plane 32 is a height (H) above the first plane 28. In some embodiments, the height (H) can be greater than about 0.1 mm, such as from about 0.1 to about 5.0 mm, or from about 0.5 to about 3.5 mm, or more preferably from about 0.7 to about 1.4 mm, and even more preferably from about 0.8 to about 1.0 mm. Of course, it is contemplated that the height (H) can be outside of this preferred range in some embodiments.

As illustrated in FIG. 3, the protuberances 25 can have a length (L). The length (L) is generally measured in the principal dimension of the protuberance 25 in the plane defined by the machine direction and cross-machine direction (CD) at a given location. In the embodiment illustrated in FIGS. 3 and 4, the discrete protuberances 25 can have a length (L) measured in the cross-machine direction (CD), length (L) being labeled for only one protuberance 25 in FIG. 3 for purposes of clarity. In other embodiments, the protuberance 25 can be discontinuous and have the principal dimension extend in the machine direction (MD). In the embodiment shown in FIGS. 5 and 6, the protuberances 25 extend the full machine direction (MD) length of the belt 20, so the length (L) can be considered as the entire length of the belt 20. The length of some belts 20 may exceed 400 m, and as such, the length (L) of a continuous protuberance 25 extending in the machine direction (MD) may be 400 m. Of course, it is contemplated that some belts 20 with continuous protuberances 25 extending in the machine direction may be less than 400 m or may be more than 400 m. In some preferred embodiments for discontinuous protuberances 25, the length (L) can be greater than 0.5 mm such as from about 0.5 to about 100 mm, or from about 0.5 to about 50 mm, or from about 0.5 to about 5.0 mm, or from about 0.5 to about 2.0 mm. Of course, it is contemplated that the length (L) can be outside of this preferred range in some embodiments having discontinuous protuberances 25.

The protuberances 25 can have a width (W). The width (W) is generally measured normal to the principal dimension of the protuberance 25 in a plane defined by the machine direction and cross-machine direction (CD) at a given location. Where the protuberance 25 has a generally square or rectangular cross-section, such as illustrated in FIGS. 3 and 4, the width (W) is generally measured as the distance between the two planar sidewalls 29 that form the protuberance 25. In those cases where the protuberance 25 does not have planar sidewalls 29 such as in the embodiment depicted in FIG. 6, the width (W) is measured at the point that provides the greatest width for the configuration of the protuberance 25. The protuberances 25 in FIGS. 3 and 4 have vertical sidewalls 29 that form rectangles or squares in cross-section, and as such, the width (W) can be measured between sidewalls 29. Such a configuration with vertical, planar sidewalls 29 is preferable for manufacturing some tissue webs. It is contemplated that the protuberances 25 could form other cross-sectional shapes, such as trapezoidal prisms where all of the sidewalls 29 may not be vertical. In such an example, the width (W) could be measured along the base of the protuberance 25 at the point where the sidewall 29 contacts the second web contacting area 30 that would provide the greatest width for the configuration of the protuberance 25. In another embodiment, the protuberances 25 in the example illustrated in FIGS. 5 and 6 form semicircles in cross-section, with the width (W) being measured along the base of the protuberance 25 in the cross-machine direction (CD) at the point where the sidewall 29 contacts the second web contacting area 30. In some preferred embodiments, the width (W) of the protuberances 25 can be from about 0.1 to about 5.0 mm, or preferably from about 0.5 to about 3.5 mm, or more preferably from about 0.7 to about 1.4 mm, and in a particularly preferred embodiment between from about 0.8 to about 1.0 mm. Of course, it is contemplated that the width (W) can be outside of this preferred range in some embodiments. For example, in some embodiments, widths W of protuberances 25 may be preferable to range from about 0.1 to about 0.3 mm.

If a belt includes multiple protuberances, it is contemplated that a plurality of or all of the protuberances can be configured substantially the same in terms of any one or more of characteristics of height (H), width (W), or length (L). It is also contemplated that a belt can be configured with protuberances configured such that one or more characteristics of height (H), width (W), or length (L) of the protuberances vary from one protuberance to another protuberance.

The spacing and arrangement of protuberances may vary depending on the desired tissue product properties and appearance. In one embodiment, such as that illustrated in FIG. 5, a plurality of protuberances 25 extend continuously throughout one dimension of the belt 20 (the machine direction) and each protuberance 25 in the plurality is spaced apart from an adjacent protuberance 25. Thus, the protuberances may be spaced apart across the entire cross-machine direction (CD) length of the belt. Alternatively, the protuberances can be configured to extend in the cross-machine direction (CD) of the belt 20 and can be spaced apart from adjacent protuberances in the machine direction of the belt. Yet another alternative for the protuberances would be to run diagonally relative to the machine and cross-machine directions. Of course, the direction of the protuberance alignments (machine direction, cross-machine direction, or diagonal) discussed above refer to the principal alignment of the protuberances. Within each alignment, the protuberances may have segments aligned at other directions, but aggregate to yield the particular alignment of the entire protuberances.

The protuberances 25 can also be designed such that the adjacent sidewalls 29 of individual protuberances 25 are equally spaced apart from one another. If such spacing occurs, the center-to-center spacing of protuberances 25 in the machine direction (MD) (such as in FIG. 3) can be referred to as machine direction (MD) pitch $P_M$ and the center-to-center spacing of protuberances 25 in the cross-machine direction (CD) (such as in FIGS. 3 and 5) can be referred to as cross-machine direction pitch $P_C$. The machine direction (MD) pitch $P_M$ and/or cross-machine direction (CD) pitch $P_C$ may be greater than about 1.0 mm, such as from about 1.0 to about 20 mm apart and more preferably from about 2.0 to about 10 mm apart. In one particularly preferred embodiment the protuberances 25 are spaced apart from one another from about 3.8 to about 4.4 mm apart. This spacing can result in a tissue web which generates maximum caliper when made of conventional cellulosic fibers. Further, this arrangement can provide a tissue web having three dimensional surface topography, yet relatively uniform density.

The preferred machine direction (MD) pitch $P_M$ and/or cross-machine direction (CD) pitch $P_C$ can be selectively designed to correspond with the height (H) of the protuberances 25. For example, a machine direction (MD) pitch $P_M$ and/or cross-machine direction (CD) pitch $P_C$ of about 3.8 to about 4.4 mm can be preferred for protuberances 25 having a height (H) of about 0.8 to about 1.0 mm. A machine direction (MD) pitch $P_M$ and/or cross-machine direction (CD) pitch $P_C$ of about 2.0 to about 2.2 mm can be preferred for protuberances 25 having a height (H) of about 0.4 to about 0.5 mm. Thus, in some preferable embodiments, it is preferred to have a ratio of machine direction (MD) pitch $P_M$ and/or cross-machine direction (CD) pitch $P_C$ to protuberance 25 height (H) between about 4:1 to about 5:1.

In other contemplated embodiments, the machine direction (MD) pitch $P_M$ and/or cross-machine direction (CD) pitch $P_C$ may vary throughout the machine direction (MD) and/or cross-machine direction (CD), respectively. Regardless of the particular pattern of protuberances 25, or whether adjacent patterns are in or out of phase with one another, the protuberances 25 can be separated from one another by some minimal distance. Preferably the distance between continuous protuberances 25 is greater than 0.5 mm and in a particularly preferred embodiment greater than about 1.0 mm and still more preferably greater than about 2.0 mm such as from about 2.0 to about 6.0 mm and still more preferably from about 3.0 to about 4.5 mm.

Where the protuberances 25 are wave-like, such as those illustrated in FIG. 5, the protuberances 25 can have an amplitude (A) and a wavelength (WL). The amplitude (A) may range from about 2.0 to about 200 mm, in a particularly preferred embodiment from about 10 to about 40 mm and still more preferably from about 18 to about 22 mm. Similarly, the wavelength (WL) may range from about 20 to about 500 mm, in a particularly preferred embodiment from about 50 to about 200 mm and still more preferably from about 80 to about 120 mm. In an especially preferred embodiment, the wavelength WL can be about 100 mm and the amplitude can be about 10 mm.

Regardless of whether the protuberances are substantially linear, wave-like or some other shape, the protuberances can be configured such that they extend substantially throughout one dimension of the belt 20 (machine direction or cross-machine direction), and each protuberance in the plurality is spaced apart from adjacent protuberances. In this manner the protuberances may span the entire cross-machine direction (CD) of the belt or may endlessly encircle the belt in the machine direction (MD). In one particularly preferred embodiment, the protuberances 25 may encircle the belt in the machine direction (MD), such as in the embodiment illustrated in FIGS. 5 and 6.

The papermaking belt 20 can also include at least one channel 34, and preferably a plurality of channels, extending from the web contacting side 24 to the machine contacting side 22 of the papermaking belt 20 to facilitate air passage between the two sides 22, 24 of the belt 20. The channels 34 generally comprise opposed first and second apertures 36, 38 which open onto the machine contacting side 22 and the web contacting side 24 of the papermaking belt 20, respectively. Preferably, the channel 34 and apertures 36, 38 are shaped so as to permit the passage of air and water through the belt in the longitudinal direction (Z). As such the channels are generally provided with a horizontal cross-section, which may be circular, oval, triangular, square, rectangular, pentagonal, or hexagonal.

As illustrated in FIG. 4 all of the protuberances 25 and landing areas 27 include a channel 34, however, the invention is not so limited. The air permeability of the belt may be modified as necessary by providing all or only a portion of the protuberances and/or land areas with channels. In certain embodiments it may be preferred to provide all of the protuberances with channels, but only a portion of the land areas, such as from about 50 to about 75 percent of the land areas. In other embodiments, such as that illustrated in FIGS. 4 and 6, the web contacting side 24 comprises a first web contacting area 26, which is generally defined by a landing area 27 lying between adjacent protuberances 25, and a second web contacting areas 30, which generally consists of a single protuberance 25, where both the first and the second web contacting areas comprise a channel 34 such that channels are evenly distributed across the machine and cross-machine directions of the belt 20.

In addition to varying the number and location of the channels, the volume of the channels may vary depending on desired permeability of the belt. In certain instances the volume of the channel may be varied depending on the volume of the belt feature it is disposed in. For example, in certain embodiments where the channel is disposed on a protuberance, the channel may have a volume of about 20 to about 90 percent of the volume of the protuberance and more preferably from about 50 to about 90 percent of the volume of the protuberance. Of course, the volume of the channels as compared to the volume of the protuberances can vary from this preferred range and still be within the scope of this disclosure.

It is contemplated that the channels 34 and the apertures 36, 38 can be of various shapes and configurations. For example, the channels 34 can be cylindrical in nature such as that shown in FIGS. 5 and 6, with the apertures 36, 38 being generally circular in shape. Alternatively, it is contemplated that the channels 34 and apertures 36, 38 could have a different configuration, such as a rectangular prism. It is contemplated that the channels 34 can have a different cross-sectional shape than the apertures 36, 38.

The apertures 36, 38 can have a cross-sectional area which can be calculated by known means by one of ordinary skill in the art. In some preferred embodiments, the channels 34 can be configured such that the cross-sectional area of the aperture 36 on the machine contacting side 22 of the belt 20 can be substantially the same as the cross-sectional area of the aperture 38 on the web contacting side 24 of the belt 20. For purposes herein, two cross-sectional areas can be referred to as being substantially the same when one cross-sectional area is within 5 percent of the other. As an example, the channels 34 can be cylindrical in nature and be of a constant diameter such that the opposed apertures 36, 38 have the same diameter, such as illustrated in FIGS. 5 and 6.

Where the apertures 36, 38 have a substantially circular cross-section the apertures 36, 38 can have a diameter of about 0.1 mm or greater, such as from about 0.1 to about 3.0 mm, more preferably from about 0.1 to about 1.0 mm, and still more preferably from about 0.1 to about 0.5 mm. If the apertures 36, 38 are square or rectangular in shape, the apertures 36, 38 can have a width and/or length of about 0.1 mm or greater, such as from about 0.1 to about 3.0 mm, more preferably from about 0.1 to about 1.0 mm, and still more preferably from about 0.1 to about 0.5 mm. In some preferred embodiments, the cross-sectional area of the aperture 36 on the machine contacting side 22 can be substantially the same as the cross-sectional area of the respective aperture 38 on the web contacting side 24 for at least a majority of the plurality of channels 34. In some embodiments, the cross-sectional area of the apertures 36, 38 can be greater than about 0.01 $mm^2$, such as from about 0.01 to about 10.0 $mm^2$, or from about 0.01 to about 1.0 $mm^2$, or more preferably from about 0.01 to about 0.25 $mm^2$.

Alternatively, it is contemplated that the channels 34 can be frusto-conical in shape (such as illustrated in FIG. 4) or can form a trapezoidal prism in shape, such that the apertures 36, 38 have different diameters and/or cross-sectional areas on the machine contacting side 22 and the web contacting side 24 of the belt 20, respectively. As an example, the diameter of an aperture 38 on the web contacting side 24 can be configured to be less than the diameter of an aperture 36 for a respective channel 34 on the machine contacting side 22 of the belt 20, as illustrated in the embodiment depicted in FIGS. 3 and 4. Alternatively, the diameter of an aperture 38 on the web contacting side 24 can be configured to be greater than the diameter of an aperture 36 for a respective channel 34 on the machine contacting side 22 of the belt 20. It is conceived that a plurality or all of the channels 34 on the belt 20 can be configured in such a fashion, or the channels 34 may vary in their configuration.

The protuberances' sidewalls 29 are generally thick enough in the area surrounding the channels 34 to resist deformation in use, such as greater than about 0.08 mm, such as from about 0.08 to about 0.5 mm and more preferably from about 0.10 to about 0.20 mm. By suitable choice of channel 34 and aperture 36, 38 dimensions and shape, the degree of visibility of the aperture pattern in the resulting tissue may be made as faint or as distinct as desired.

In some embodiments, such as the embodiment depicted in FIG. 6, the protuberances 25 may comprise one or more channels 40 extending through the sidewalls 29. The sidewall 29 channels 40 may generally have any orientation so long as they extend continuously from the outer surface of the sidewall 29 to the inner sidewall surface. In one embodiment the sidewall 29 channel 40 is oriented substantially in parallel to the plane defined by the machine direction (MD) and cross-machine direction (CD), or parallel to the first plane 28 and second plane 32 of the web contacting side 24 of the belt 20. The channels 40 in the sidewalls 29 may be located along any height (H) of the protuberance 25, however, in certain embodiments to improve the molding of the tissue web, the channels 40 in the sidewalls 29 are disposed along the lower third of the protuberance 25 and more preferably adjacent to the point at which the protuberance 25 contacts the first plane 28 of the web contacting side of the belt 20. As illustrated in FIG. 6, the sidewall 29 channels 40 can intersect with the channel 34 of the protuberances 25 discussed above that extend from the machine contacting side 22 to the web contacting side 24 of the belt 20.

In some embodiments, the belt 20 can also include sacrificial wear elements 42. The sacrificial wear elements 42 can be disposed on the machine contacting side 22 of the belt 20. The sacrificial wear elements 42 can be of a variety of shapes and sizes, such as rounded (FIG. 6), or rectangular (FIG. 4). The sacrificial wear elements 42 can extend the effective life of the belt 20.

As will be discussed in further detail below, the papermaking belt 20 can be manufactured such that it does not have a seam as in traditional papermaking belts 10, providing the advantages as noted above. By removing the seam, effective belt life can be increased and more consistent characteristics in air transfer/permeability of the belt 20 can be provided, leading to more consistent characteristics for the tissue or paper product(s) manufactured using the belt 20.

Furthermore, the papermaking belt 20 can be manufactured such that the first web contacting area 26 can be comprised of a first belt material and the second web contacting area 30 can be comprised of a second belt material. In preferred embodiments, the first belt material and the second belt material are the same. Additionally and/or alternatively, the machine contacting side 22 of the belt 20 can be comprised of the same material as the first belt material forming the first web contacting area 26 and/or the second material forming the second web contacting area 30. Such a preferred embodiment can provide a structure in which the first web contacting area 26 and the second web contacting area 30 are monolithic in nature and have consistent properties.

As one example, by having a monolithic structure, the durability of the protuberances 25 can be increased as compared to protuberances 25 that may be applied to a different underlying carrier structure. Additionally, an air permeability of the machine contacting side 22 of the belt 20 can be substantially the same as an air permeability of the web contacting side 24 of the belt 20. For purposes herein, the air permeability can be measured by the Frazier Air Permeability test as known in the art. The Frazier Air Permeability test measures the permeability of a fabric as standard cubic feet of air flow per square foot of material per minute with an air pressure differential of 0.5 inches (12.7 mm) of water under standard conditions. For example, through drying fabrics can have a permeability from about 55 standard cubic feet per square foot per minute (about 16 standard cubic meters per square meter per minute) or higher, more specifically from about 100 standard cubic feet per square foot per minute (about 30 standard cubic meters per square meter per minute) to about 1,700 standard cubic feet per square foot per minute (about 520 standard cubic meters per square meter per minute), and most specifically from about 200 standard cubic feet per square foot per minute (about 60 standard cubic meters per square meter per minute) to about 1,500 standard cubic feet per square foot per minute (about 460 standard cubic meters per square meter per minute). For purposes herein, two measured air permeabilities can be referred to as being "substantially the same" when one air permeability value is within 5 percent of the comparative air permeability value. By having the first web contacting area 26 and the second web contacting area 30 be comprised of the same belt material, it is believed that the air permeability of the first web contacting area 26 can be substantially the same as the air permeability of the second web contacting area 30, which can be inferred by the cross-sectional area of the apertures 38 in the first web contacting area 26 and the cross-sectional area of the apertures 38 in the second web contacting area 30 and the spacing between the protuberances 25.

Additional benefits can be provided by constructing a belt in which the first web contacting area and the second web contacting area are comprised of the same belt material. For example, the release properties of the first web contacting area can be substantially the same as the release properties of the second web contacting area in relation to the tissue web or product being carried by the belt due to such a monolithic structure. The belt can also be more resistant to abrasion, puncture, shower damage, thermal degradation, hydrolysis, chemical damage, and loss of adhesion.

In some embodiments, the sacrificial wear elements 42 can be comprised of the same material as the first belt material forming the first web contacting area 26 and/or the second material forming the second web contacting area 30 and/or the material forming the machine contacting side 22 of the belt 20. However, in other embodiments, the sacrificial wear elements 42 can be comprised of a different material than the first belt material forming the first web contacting area 26 and/or the second material forming the second web contacting area 30 and/or the material forming the machine contacting side 22 of the belt 20. For example, the sacrificial wear elements 42 can be comprised of a more durable material than the first belt material forming the first web contacting area 26 and/or the second material forming the second web contacting area 30 and/or the material forming the machine contacting side 22 of the belt 20.

In preferred embodiments, the belt 20 and the protuberances 25 and other associated structures as described above can be manufactured from a polymeric material. In a preferred embodiment, the belt 20 can be manufactured via "continuous liquid interphase printing" (hereinafter abbreviated to CLIP) as described in International Publication No. WO 2014/126837, the contents of which are hereby incorporated by reference in a manner consistent with the present disclosure. CLIP generally employs a support, a carrier associated with the support, and an optically transparent member having a build surface, the carrier and the build surface defining a build region there between being filled with a polymerizable liquid. A source of irradiation is supplied to the build region through the optically transparent member to form a solid polymer from the polymerizable liquid while moving the carrier away from the build surface to form a three-dimensional object from the polymer. The carrier can be controlled by a controller that is also in communication with the radiation source. In such a manufacturing method, the belt 20 protuberances 25 can be formed on the carrier from the polymerizable liquid from the irradiation as the carrier moves away from the build surface.

Any suitable polymerizable liquid can be used with CLIP to form the belt. Preferred polymerizable materials can include those sufficient of withstanding high temperatures and humid environments in which the papermaking belt may be employed in manufacturing of tissue webs. Polymerizable materials can include a monomer, particularly photopolymerizable and/or free radical polymerizable monomers, and a suitable initiator such as a free radical initiator, and combinations thereof. Examples include, but are not limited to, acrylics, methacrylics, acrylamides, styrenics, olefins, halogenated olefins, cyclic alkenes, maleic anhydride, alkenes, alkynes, carbon monoxide, functionalized oligomers, multifunctional cute site monomers, functionalized PEGs, etc., including combinations thereof.

In certain instances the polymerizable material may include solid particles suspended or dispersed therein. Any suitable solid particle can be used, depending upon the end product being fabricated. The particles can be metallic, organic/polymeric, inorganic, or composites or mixtures thereof. In certain embodiments the polymerizable materials may include a semi-conductive, or conductive material, such as a conductive metal, to improve or facilitate heat transfer.

The CLIP process generally begins with creating a computer model of the belt in three dimensions using a suitable computer modeling program known in the art. The computer model of the belt can be processed by the controller that among other things, can control the radiation source intensity, temperature of the carrier, amount of polymerizable liquid in the building zone, temperature of the growing product and build plate, pressure, speed of advancing the carrier, pressure, force, and strain, as a means of controlling the building of the belt to the specifications in the computer model.

While the inventive seamless belt has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

Embodiment 1

A seamless papermaking belt comprising a machine contacting side and a web contacting side, the web contacting side being opposite from the machine contacting side, the web contacting side comprising: a first web contacting area defining a first plane; and a second web contacting area defining a second plane, the second plane being above the first plane; wherein the first web contacting area and the second web contacting area comprise a plurality of channels that extend from the web contacting side to the machine contacting side of the seamless papermaking belt.

Embodiment 2

The seamless papermaking belt of embodiment 1, wherein the air permeability of the first web contacting area is substantially the same as the air permeability of the second web contacting area.

Embodiment 3

The seamless papermaking belt of any one of the preceding embodiments, wherein the air permeability of the machine contacting side is substantially the same as the air permeability of the web contacting side.

Embodiment 4

The seamless papermaking belt of any one of the preceding embodiments, wherein the plurality of channels each include an aperture on the web contacting side having a first cross-sectional area and an aperture on the machine contacting side having a second cross-sectional area.

Embodiment 5

The seamless papermaking belt of embodiment 4, wherein the first cross-sectional area is substantially the same as or less than the second cross-sectional area for a majority of the plurality of channels.

Embodiment 6

The seamless papermaking belt of embodiment 4 or 5, wherein the first cross-sectional area and the second cross-sectional area are each between about 0.01 and 10.0 $mm^2$ for a majority of the plurality of channels.

Embodiment 7

The seamless papermaking belt of any one of embodiments 4 through 6, wherein the spacing between adjacent apertures on the web contacting side is substantially uniform.

Embodiment 8

The seamless papermaking belt of any one of the preceding embodiments, wherein the machine contacting side comprises sacrificial wear elements.

Embodiment 9

A papermaking belt comprising: a machine contacting side, the machine contacting side comprising a machine contacting side belt material; a web contacting side; and a plurality of channels, the plurality of channels extending from the web contacting side to the machine contacting side; wherein the web contacting side is opposite from the machine contacting side, and the web contacting side comprises: a first web contacting area defining a first plane and being comprised of a first belt material, the first belt material being the same material as the machine contacting side belt material; and a second web contacting area defining a second plane, the second plane being above the first plane, and the second web contacting area being comprised of a second belt material.

Embodiment 10

The papermaking belt of embodiment 9, wherein the second belt material is the same material as the machine contacting side belt material.

Embodiment 11

The papermaking belt of any one of embodiments 9 or 10, wherein the papermaking belt is seamless.

Embodiment 12

The papermaking belt of any one of embodiments 9 through 11, wherein both the first web contacting area and the second web contacting area include at least some of the plurality of channels.

Embodiment 13

The papermaking belt of any one of embodiments 9 through 12, wherein the air permeability of the first web contacting area is substantially the same as the air permeability of the second web contacting area.

Embodiment 14

The papermaking belt of any one of embodiments 9 through 13, wherein the air permeability of the machine contacting side is substantially the same as the air permeability of the web contacting side.

Embodiment 15

The papermaking belt of any one of embodiments 9 through 14, wherein the plurality of channels each include an aperture on the web contacting side having a first cross-sectional area and an aperture on the machine contacting side having a second cross-sectional area.

Embodiment 16

The papermaking belt of embodiment 15, wherein the first cross-sectional area is substantially the same as or less than the second cross-sectional area for a majority of the plurality of channels.

Embodiment 17

The papermaking belt of embodiment 15 or 16, wherein the first cross-sectional area and the second cross-sectional area are each between about 0.01 and 10.0 $mm^2$ for a majority of the plurality of channels.

Embodiment 18

The papermaking belt of any one of embodiments 15 through 17, wherein spacing between adjacent apertures on the web contacting side is substantially uniform.

Embodiment 19

The papermaking belt of any one of embodiments 9 through 18, wherein the machine contacting side comprises sacrificial wear elements.

What is claimed is:

1. A seamless papermaking belt comprising a machine contacting side and a web contacting side, the web contacting side being opposite from the machine contacting side, the web contacting side comprising: a first web contacting area defining a first plane; and a second web contacting area defining a second plane, the second plane being above the first plane; wherein the first web contacting area and the second web contacting area comprise a plurality of channels that extend from the web contacting side to the machine contacting side of the seamless papermaking belt.

2. The seamless papermaking belt of claim 1, wherein first web contacting area has a first air permeability and the second web contacting area has a second air permeability, wherein the first and second air permeabilities are substantially identical.

3. The seamless papermaking belt of claim 1, wherein the air permeability of the machine contacting side is substantially the same as the air permeability of the web contacting side.

4. The seamless papermaking belt of claim 1, wherein the plurality of channels each include an aperture on the web contacting side having a first cross-sectional area and an aperture on the machine contacting side having a second cross-sectional area.

5. The seamless papermaking belt of claim 4, wherein the first cross-sectional area is substantially equal to or less than the second cross-sectional area for a majority of the plurality of channels.

6. The seamless papermaking belt of claim 4, wherein the first cross-sectional area and the second cross-sectional area are each between about 0.01 and 10.0 $mm^2$ for a majority of the plurality of channels.

7. The seamless papermaking belt of claim 4, wherein the spacing between adjacent apertures on the web contacting side is substantially uniform.

8. The seamless papermaking belt of claim 1, wherein the machine contacting side comprises sacrificial wear elements.

9. A papermaking belt comprising:

a machine contacting side, the machine contacting side comprising a machine contacting side belt material;

a web contacting side, the web contacting side being opposite from the machine contacting side, the web contacting side comprising:

a first web contacting area defining a first plane and being comprised of a first belt material, the first belt material being the same material as the machine contacting side belt material; and a second web contacting area defining a second plane, the second plane being above the first plane, the second web contacting area being comprised of a second belt material; and a plurality of channels, the plurality of channels extending from the web contacting side to the machine contacting side.

10. The papermaking belt of claim 9, wherein the second belt material is the same material as the machine contacting side belt material.

11. The papermaking belt of claim 9, wherein the papermaking belt is seamless.

12. The papermaking belt of claim 9, wherein both the first web contacting area and the second web contacting area include at least some of the plurality of channels.

13. The papermaking belt of claim 9, wherein the first web contacting area has a first air permeability and the second web contacting area has a second air permeability, wherein the first and second air permeabilities are substantially identical.

14. The papermaking belt of claim 9, wherein the air permeability of the machine contacting side is substantially the same as the air permeability of the web contacting side.

15. The papermaking belt of claim 9, wherein the plurality of channels each include an aperture on the web contacting side having a first cross-sectional area and an aperture on the machine contacting side having a second cross-sectional area.

16. The papermaking belt of claim 15, wherein the first cross-sectional area is substantially the same as or less than the second cross-sectional area for a majority of the plurality of channels.

17. The papermaking belt of claim 15, wherein the first cross-sectional area and the second cross-sectional area are each between about 0.01 and 10.0 $mm^2$ for a majority of the plurality of channels.

18. The papermaking belt of claim 15, wherein the spacing between adjacent apertures on the web contacting side is substantially uniform.

19. The papermaking belt of claim 9, wherein the machine contacting side comprises sacrificial wear elements.

20. A seamless papermaking belt having a machine contacting side and an opposing web contacting side, the belt comprising a first web contacting area defining a first plane and having a plurality of channels extending from the machine contacting side to the web contacting side; and a plurality of protuberances having a first and second sidewall and defining a second web contacting area lying in a second plane, the second plane being above the first plane; wherein at least a portion of the plurality of protuberances comprise a first channel extending from the machine contacting side to the web contacting side and a second channel that intersects the first channel.

* * * * *